US008035572B2

(12) United States Patent
Yun et al.

(10) Patent No.: US 8,035,572 B2
(45) Date of Patent: Oct. 11, 2011

(54) H-TYPE MONOPOLE ISOLATION ANTENNA

(75) Inventors: Je-hoon Yun, Daejeon (KR); Joung-myoun Kim, Daejeon (KR); Ung-hee Park, Daejeon (KR); Soon-ik Jeon, Daejeon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 1056 days.

(21) Appl. No.: 11/722,248

(22) PCT Filed: Dec. 21, 2005

(86) PCT No.: PCT/KR2005/004428

§ 371 (c)(1),
(2), (4) Date: Jun. 20, 2007

(87) PCT Pub. No.: WO2006/068418

PCT Pub. Date: Jun. 29, 2006

(65) Prior Publication Data

US 2010/0001922 A1 Jan. 7, 2010

(30) Foreign Application Priority Data

Dec. 21, 2004 (KR) ..... 10-2004-0109404

(51) Int. Cl.
*H01Q 21/00* (2006.01)

(52) U.S. Cl. ..... 343/879; 343/890

(58) Field of Classification Search ..... 343/878, 343/879, 890, 891
See application file for complete search history.

(56) References Cited

U.S. PATENT DOCUMENTS

| | | | | |
|---|---|---|---|---|
| 5,262,793 | A * | 11/1993 | Sperry | 343/713 |
| 5,291,211 | A * | 3/1994 | Tropper | 343/890 |
| 6,313,800 | B1 * | 11/2001 | Kallina | 343/715 |
| 6,531,984 | B1 | 3/2003 | Johannisson et al. | |
| 2002/0135523 | A1 | 9/2002 | Romero et al. | |

FOREIGN PATENT DOCUMENTS

EP 1071160 1/2001

(Continued)

OTHER PUBLICATIONS

Karode, S.L., et al. (1999). "Dual Polarised Microstrip Patch Antenna Using Feedforward Isolation Enhancement for Simultaneous Transmit/Receive Applications." *National Conference on Antennas and Propagation*. Mar. 30-Apr. 1, 1999. Conference Publication No. 461, IEE 1999. pp. 49-52.

(Continued)

*Primary Examiner* — Tan Ho
(74) *Attorney, Agent, or Firm* — Ladas & Parry LLP

(57) ABSTRACT

Provided is an H-type monopole isolation antenna. The antenna provides an H-type monopole isolation antenna which can gain a high bi-directional transmitting/receiving isolation between a transmitting antenna and a receiving antenna of co-channel/co-polarization by including an antenna symmetrically positioned in right/left sides based on a covering means. A transmitting/receiving isolation antenna for maintaining high isolation between a transmitting signal and a receiving signal includes a cover which includes a conductor; and first and second antennas which are bisymmetrically positioned in right and left parts of the covering means and separately operated as a transmitting antenna or a receiving antenna. The antenna is used in a co-channel bi-direction repeater system.

16 Claims, 5 Drawing Sheets

FOREIGN PATENT DOCUMENTS

| | | |
|---|---|---|
| JP | 5-80148 | 4/1993 |
| KR | 100192375 | 1/1999 |
| KR | 1020020046238 | 6/2002 |
| KR | 1020030021977 | 3/2003 |
| KR | 1020030065609 | 8/2003 |
| KR | 1020040027389 | 4/2004 |
| KR | 1020040091343 | 10/2004 |

OTHER PUBLICATIONS

Hao, Y., et al. (2001). "Isolation Enhancement of PBG Microstrip Diplexer Patch Antenna." *11th International Conference on Antennas and Propagation*. Conference Publication No. 480. IEE 2001. pp. 86-89.

* cited by examiner

[Fig. 2]
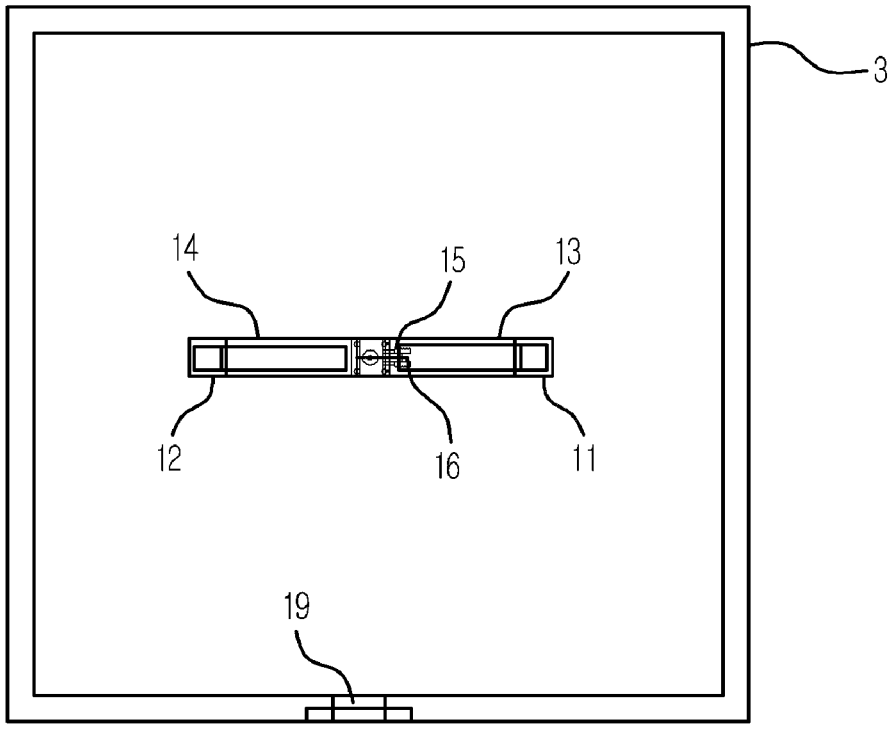
[Fig. 3]
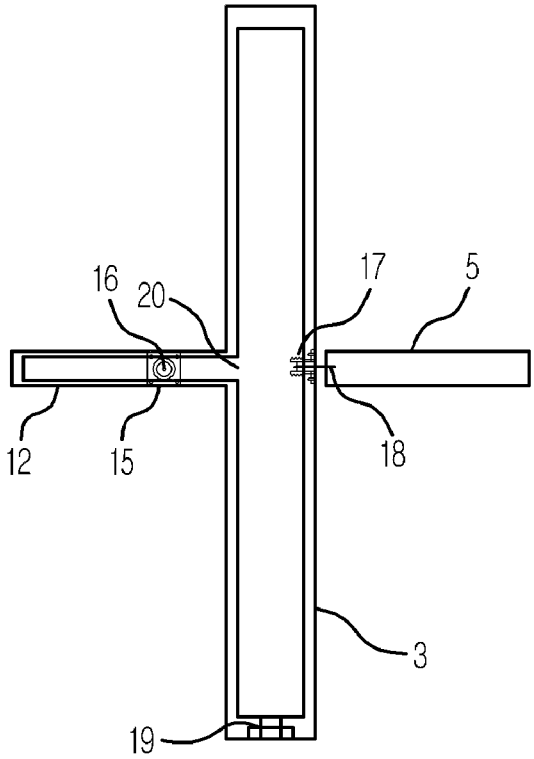

[Fig. 4]
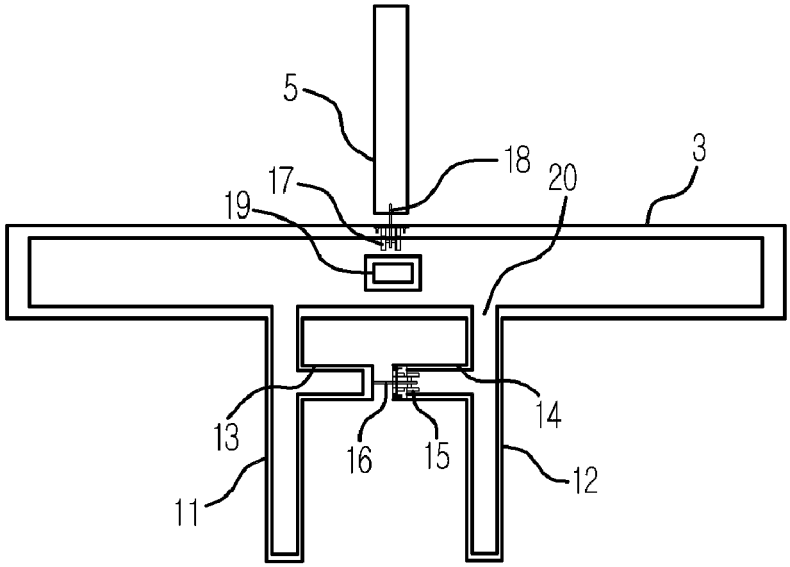
[Fig. 5]
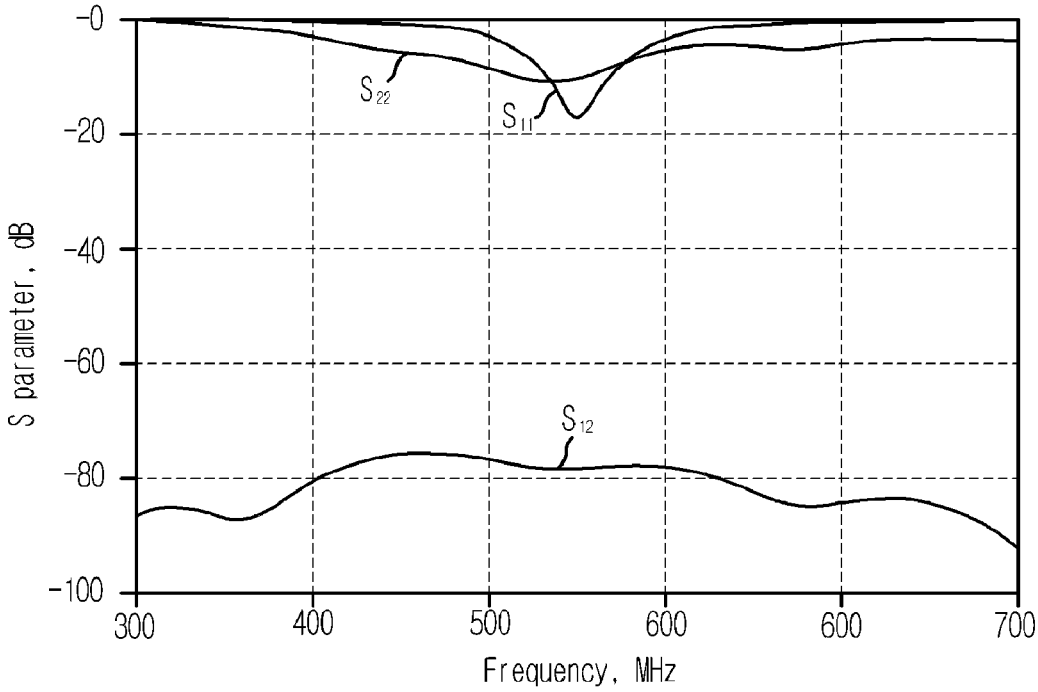

[Fig. 6]
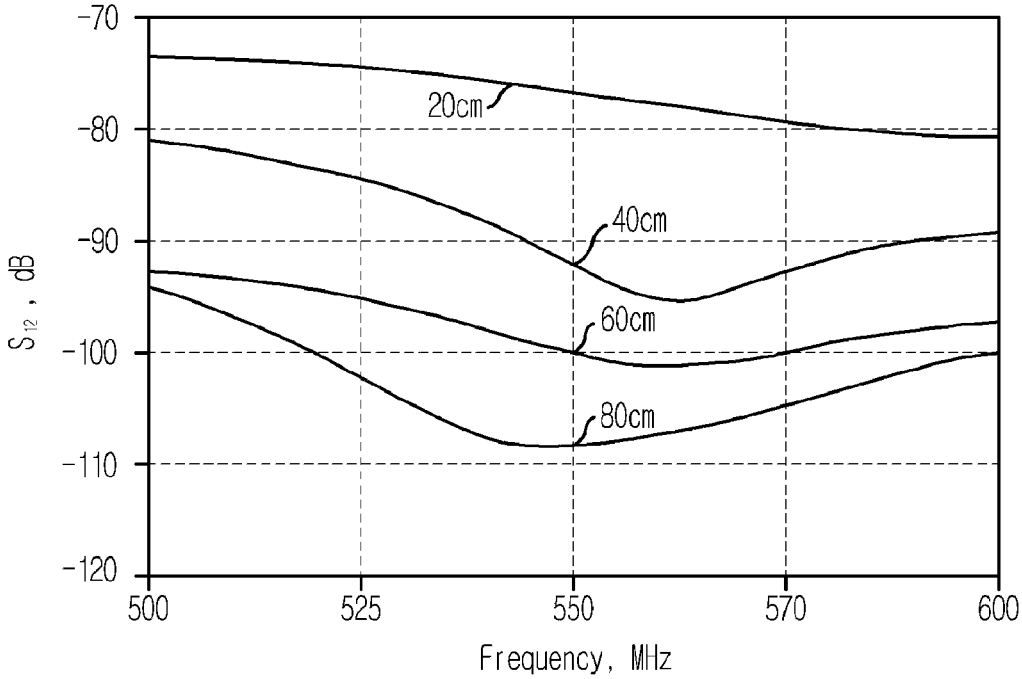
[Fig. 7]
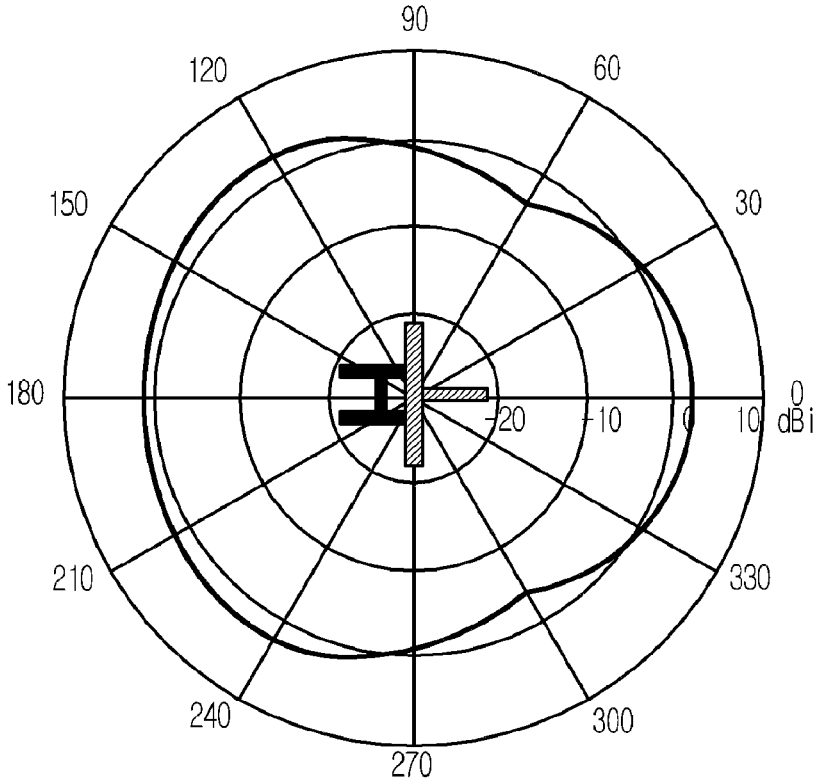

[Fig. 8]
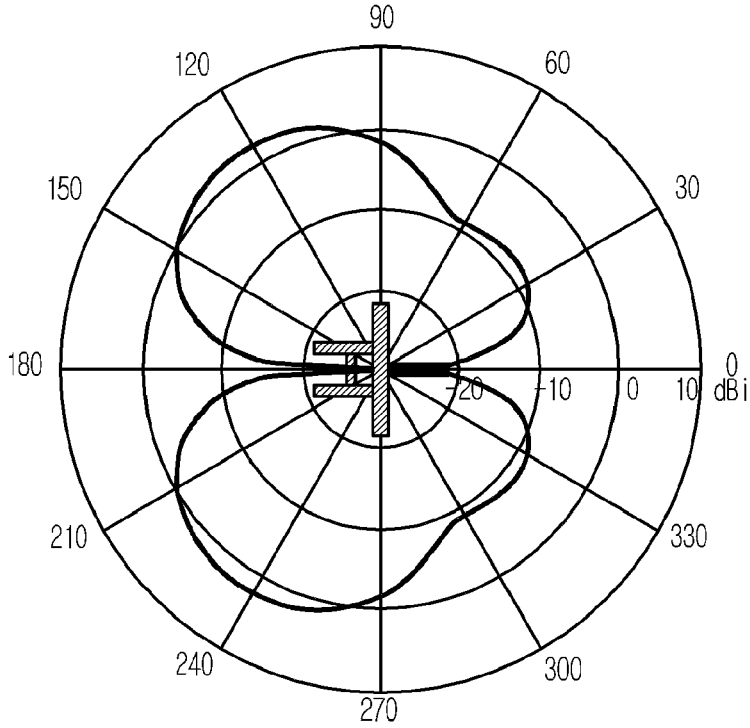
[Fig. 9]
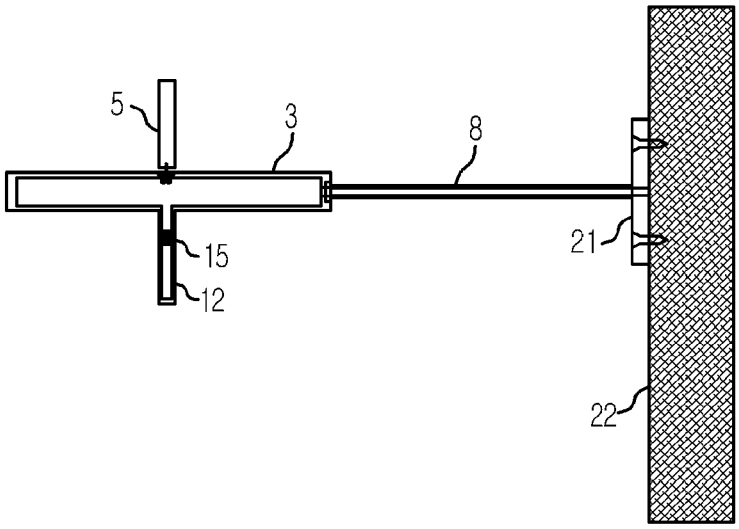
[Fig. 10]
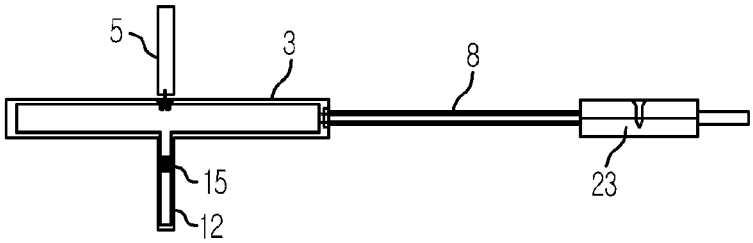

H-TYPE MONOPOLE ISOLATION ANTENNA

TECHNICAL FIELD

The present invention relates to an H-type monopole isolation antenna; and, more particularly, to an H-type monopole isolation antenna for isolating a transmitting signal and a receiving signal in a co-channel, a co-polarization and a co-direction.

BACKGROUND ART

An isolation technology for separating transmitting/receiving signals in an antenna has been studied for a long time. The conventional isolation technology can be divided into two technologies according to propagation direction.

The first one is a unidirectional repeater, i.e., an antenna technology for receiving a receiving signal in the rear part and transmitting an amplified signal in the front part. This technology is used in a repeater system for co-channel broadcasting and it will be called a unidirectional isolation technology hereinafter. In the antenna technology, the transmitting signal is not transmitted in a direction that the transmitting signal is received, and a repeater for the co-channel broadcasting is used representatively and generally.

Since the unidirectional isolation technology gains high isolation by setting up high-directional antennas in opposition to each other and spacing them from each other, the unidirectional isolation technology has a shortcoming that it requires much space for setup.

Therefore, a broadcasting repeater using the conventional unidirectional isolation technology is used by setting up a receiving antenna in the lower part of a high iron tower and a transmitting antenna in the upper part.

The other conventional technology is a bi-directional isolation technology for re-transmitting in a co-direction. Specifically, there is a bi-directional isolation technology based on polarization.

That is, the technology raises the degree of isolation of the transmitting/receiving signals by generating polarizations of the transmitting/receiving signals.

However, the conventional bi-directional isolation technology has a problem that a distance length should be sufficiently acquired between the receiving antenna, i.e., the horizontal polarization and the transmitting antenna, i.e., the vertical polarization.

Another conventional technology, which is not applied to a practical system, generates the transmitting signal and the receiving signal, whose polarizations are perpendicular to each other, and maintains isolation between two terminals by vertically setting up their feed in a patch antenna. This is revealed in an article by Karode, in *IEE National Conference on Antennas and Propagation*, pp. 49-52, April 1999).

Also, Hao has realized an isolation technology by differentiating polarization generation of the patch antenna applying a photo band gap (PBG) structure in an article published in *IEE,* 11$^{th}$ *International Conference on Antenna Propagation*, pp. 86-89, April 2001).

However, as shown in the result, since the isolation for a co-frequency of the transmitting/receiving signals is very low, the technology is not proper as an antenna for co-channel bi-directional communications in diverse fields of mobile communications, short distance communications, a broadcasting repeater and satellite communications requiring high isolation for the co-frequency.

In the result of the conventional technologies suggested by Karodo and Hao, isolation is not more than about 60 dB although transmitting/receiving frequency bands or polarizations are different from each other.

Therefore, the isolation antenna, which is required for a co-channel wireless Local Area Network (LAN) low output repeater, a Radio Frequency (RF) reader antenna, an antenna for testing Radar Cross Section (RCS), and an isolation antenna capable of co-channel, co-polarization and bi-directional communications which is necessary in co-channel bi-directional communication devices.

DISCLOSURE OF INVENTION

Technical Problem

It is, therefore, an object of the present invention to provide an H-type monopole isolation antenna which can gain a high bi-directional transmitting/receiving isolation between a transmitting antenna and a receiving antenna of co-channel/co-polarization by including an antenna symmetrically positioned in the right/left sides based on a covering means between them.

Other objects and advantages of the invention will be understood by the following description and become more apparent from the embodiments in accordance with the present invention, which are set forth hereinafter. It will be also apparent that objects and advantages of the invention can be embodied easily by the means defined in claims and combinations thereof.

Technical Solution

In accordance with one aspect of the present invention, there is provided a transmitting/receiving isolation antenna maintaining high isolation between a transmitting signal and a receiving signal, including: a cover which includes a conductor; and first and second antennas which are symmetrically positioned in right and left parts of the covering means and operated as a transmitting antenna or a receiving antenna respectively.

In accordance with another aspect of the present invention, the antenna further includes: a supporter for supporting the cover by being connected to a lower central part of the cover and a base for vertically fixing the supporter on a surface.

Advantageous Effects

The present invention can acquire high isolation more than 75 dB although the transmitting/receiving antennas are set up adjacently and a small covering housing is used in a co-channel, co-polarization and co-direction.

Also, the present invention can realize high isolation by a small antenna and it can be applied to a bi-directional antenna or an antenna requiring high bi-directional transmission/reception isolation, such as a wireless Local Area Network (LAN), a Radio Frequency Identification (RFID) reader, a monitoring system, a Radar Cross Section (RCS) measuring system and a co-channel mobile communication system.

Also, since the antenna of the present invention can be fabricated in the form of a wall-hanging device or a device integrated with a power outlet, it can widen a usage range and independently realize the system in a small space.

BRIEF DESCRIPTION OF THE DRAWINGS

The above and other objects and features of the present invention will become apparent from the following description of the preferred embodiments given in conjunction with the accompanying drawings, in which:

FIG. 2 is a cross-sectional front view showing the antenna device in accordance with the embodiment of the present invention;

FIG. 3 is a cross-sectional side view showing the antenna device in accordance with the embodiment of the present invention;

FIG. 4 is a cross-sectional plane view showing the antenna device in accordance with the embodiment of the present invention;

FIG. 5 is a graph showing an S parameter characteristic of the H-type monopole isolation antenna in accordance with the embodiment of the present invention;

FIG. 6 is a graph showing $S_{12}$ parameter characteristics based on the size of a covering housing of the H-type monopole isolation antenna in accordance with the embodiment of the present invention;

FIG. 7 is a smith chart showing an H-Plane radiated electric field pattern, i.e., horizontal polarization, by a first antenna of the H-type monopole isolation antenna in accordance with the embodiment of the present invention;

FIG. 8 is a smith chart showing the H-plane radiated electric field pattern, i.e., the horizontal polarization, by a second antenna of the H-type monopole isolation antenna in accordance with the embodiment of the present invention;

FIG. 9 is a view showing an H-type monopole isolation antenna being fixed on a wall and used in accordance with an embodiment of the present invention; and FIG. 10 is a view showing the H-type monopole isolation antenna being used as a device integrated with a power outlet in accordance with the embodiment of the present invention.

MODE FOR THE INVENTION

Figure 1:
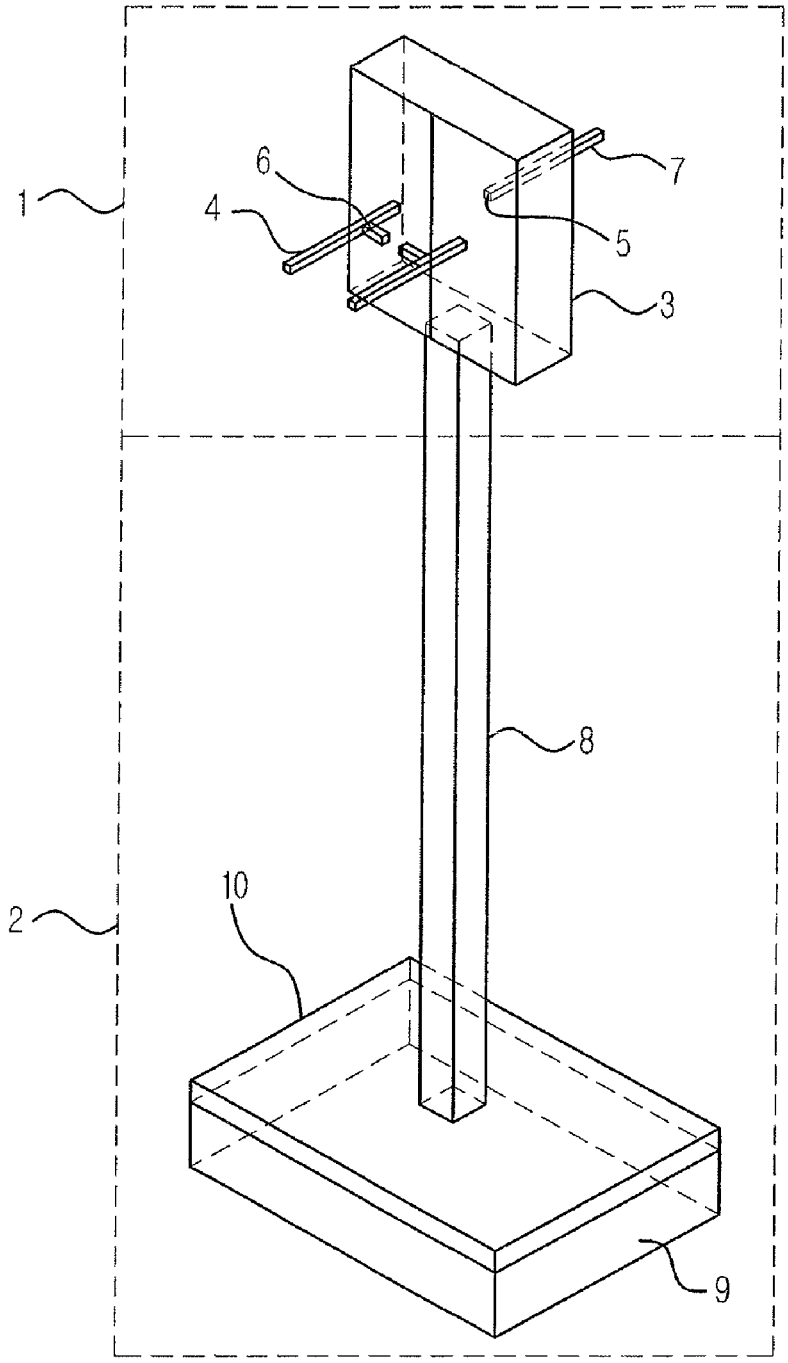
FIG. 1 is a perspective view showing an H-type monopole isolation antenna in accordance with an embodiment of the present invention.

Other objects and advantages of the present invention will become apparent from the following description of the embodiments with reference to the accompanying drawings. Therefore, those skilled in the art that the present invention is included can embody the technological concept and scope of the invention easily. In addition, if it is considered that detailed description on prior art may blur the points of the present invention, the detailed description will not be provided herein. The preferred embodiments of the present invention will be described in detail hereinafter with reference to the attached drawings.

FIG. 1 is a perspective view showing an H-type monopole isolation antenna in accordance with an embodiment of the present invention.

As shown in FIG. 1, the H-type monopole isolation antenna of the present invention includes an antenna device 1 for generating radiated electromagnetic wave or receiving electromagnetic wave, and an antenna supporter 2 for supporting the antenna device 1.

The antenna device 1 includes a covering housing 3, which is covered with a conductor such as gold, silver, aluminum and copper, and have a space inside, and first and second antennas 4 and 5, which are separately set up in both sides of the covering housing 3.

The first antenna 4 is an H-type monopole antenna and vertically positioned on top of the covering housing 3.

Also, the first antenna 4 includes a first antenna feeder 6 for feeding the antenna in a central part of an H-shaped form. Herein, feeding through the first antenna feeder 6 is performed horizontally to the covering housing 3.

The second antenna 5 is a general monopole antenna and is positioned in a region in contact with the covering housing 3, and includes a second antenna feeder 7 for vertically feeding the covering housing 3.

The antenna supporter 2 includes an antenna device supporter 8 and an antenna base 9 for supporting the antenna device 1.

Herein, the antenna device supporter 8 is formed in the shape of a pipe having a space inside and is set up in a central part of the antenna device 1 as shown in FIG. 1.

The embodiment of FIG. 1 has a structure that horizontal polarization is generated with respect to an earth surface.

Therefore, since reflection by the earth surface is generated a lot in the horizontal polarization in comparison with a vertical polarization and the reflected wave deteriorates transmitting/receiving isolation, the antenna base 9 includes an electric wave absorber 10 for suppressing the reflected wave to remove the reflected wave.

Herein, reflexibility can be lowered by raising the height of the antenna device supporter 8 as well as setting up the electric wave absorber 10.

FIG. 2 is a cross-sectional front view of the antenna device in accordance with the embodiment of the present invention and shows a detailed structure of the first antenna feeder.

The first antenna 4 has a structure in which right and left antenna devices 11 and 12 having a pipe shape formed of a metal conductor such as gold, silver, copper and aluminum, are vertically positioned in the covering housing 3 just as a monopole, and the first antenna feeder 6 for feeding power is positioned in a region where right and left antenna supporters 13 and 14 contact each other between the right and left antenna devices 11 and 12.

As shown in the drawing, the first antenna feeder 6 includes a first connector 15 and a first connector pin 16.

Herein, the right and left antenna supporters 13 and 14 are formed in the shape of a conductive pipe.

A front head of the first connector 15 is positioned in the inside of the right antenna supporter 13, and the first connector pin 16 is welded into the left antenna supporter 14. Accordingly, the first antenna 4 has a structure that the first antenna 4 feeds horizontally a metal surface of the covering housing 3.

A coaxial cable connected to the first connector 15 is connected to the inside of the covering housing 3 having a space inside through the inside of the right antenna supporter 13 and the inside of the right antenna device 11.

Meanwhile, the covering housing 3 is directly connected to the antenna device supporter 8 through an opening 19 of the antenna device supporter.

FIG. 3 is a cross-sectional side view showing the antenna device in accordance with the embodiment of the present invention and shows the second antenna feeder 7 in detail.

As shown in FIG. 3, the second antenna feeder 7 has a structure that the second connector 17 is set up in the covering housing and the second connector pin 18 is connected to the second antenna.

A front head of the second connector 17 is positioned in the inside of the covering housing 3 and formed to be able to connect the coaxial cable.

Although an antenna feeding point is entirely wrapped and fixed by using a dielectric to stand firmly against an external environment such as wind (not shown in the drawing), it does not affect a characteristic a lot.

Meanwhile, antenna devices 11 and 12 of the first antenna are formed in the shape of a pipe having a space inside and are directly connected to the inside of the covering housing 3 through an opening 20 of the first antenna device.

FIG. 4 is a cross-sectional plane view showing an antenna device in accordance with the embodiment of the present invention. It shows positions of the right and left antenna supporters 14 and 15 of the first antenna in right and left antenna devices 12 and 13.

Also, as described above, the drawing shows that the first connector 15 connected to the first antenna feeder can be connected in an inside of the covering housing 3 through the coaxial cable.

As described above with reference to FIGS. 2 and 3, the antenna device supporter 8 should be positioned in a center of the antenna device 1 to position the antenna device supporter 8 in the center of the antenna device 1 where the right and left antenna devices 12 and 13 of the first antenna, which is the H-type monopole antenna, are symmetrically positioned.

This is for the following two objects.

One is to make the radiated electromagnetic wave and scattered wave by the antenna device supporter 8 arrive at the right and left antenna devices 11 and 12 in the same phase and same intensity, when the second antenna is excited with a transmitter.

Since it makes an electric potential difference between the right and left antenna supporters 13 and 14 identical, it prevents the radiated electromagnetic wave and scattered wave from being received after offset in the H-type monopole antenna, which is the first antenna.

The other one is also to make the radiated wave and the scattered wave arrive at the right and left antenna devices in the same phase and the same intensity, when radiated wave excited by the first antenna forms scattered wave by a surface and arrives at the second antenna. Herein, a technology for offsetting and decreasing a signal transmitted from the first antenna, which is the H-type monopole antenna, is added.

The antenna device supporter 8 can be formed in a pipe shape 19 by the conductors such as gold, silver, copper and aluminum. The coaxial cable connected to the first and second antennas in the inside of the pipe is sent under the surface and can be used by being connected to the repeater or the communications system.

The left and right antenna devices 11 and 12, the left and right antenna supporters 13 and 14, and the antenna device supporter 8 of the first antenna can be formed in the shape of a cylindrical pipe, of which a cross section is a circle.

FIG. 5 is a graph showing S parameter characteristics of the H-type monopole isolation antenna in accordance with the embodiment of the present invention.

A reference specification of an antenna used for measuring is as follows.

The second antenna has a width of 1 cm×1 cm and an entire length of 15 cm, and the first antenna also has the width of 1 cm×1 cm, which is the same as the second antenna. The left/right antenna devices 11 and 12 have a length of 13 cm, and a distance between the left/right antenna devices 11 and 12 is 6 cm. The covering housing has a size of 2 cm×16 cm×20 cm.

As shown in FIG. 5, resonance of the first antenna and the second antenna is generated at 550 MHz.

Herein, all values of S11 and S22 parameters are equal to or smaller than −10 dB and it shows that impedance matching is well performed.

The measurement result shows that the H-type monopole antenna, which is the first antenna, can be used as the transmitting/receiving antenna although the H-type monopole antenna is independently operated.

Also, FIG. 5 shows that a ratio of electromagnetic wave abandoned in the H-type monopole antenna, which is the first antenna radiated to the electromagnetic wave through the transmitting antenna is maintained at −75 dB and under when the monopole antenna, which is the second antenna, is used as the transmitting antenna. Herein, the rate means an $S_{12}$ characteristic showing the isolation.

That is, although a length of the covering housing is smaller than a half-wave length, high isolation is acquired. Herein, half-wave of 550 MHz is 27 cm.

The isolation is varied based on the size of the covering housing. It will be described hereinafter with reference to FIG. 6 that isolation is varied by the antenna device when the size of the covering housing is varied in the range of 20 cm to 80 cm.

FIG. 6 is a graph showing the $S_{12}$ parameter characteristics based on the size of a covering housing of the H-type monopole isolation antenna in accordance with the embodiment of the present invention.

As shown in FIG. 6, when the size of the covering housing increases in a range of 20 cm to 80 cm, isolation ratio is improved by about 30 dB.

Also, when the size of the covering housing is 60 cm, the isolation rate is maintained at about −100 dB. That is, when the covering housing maintains about 1 wavelength, the isolation is maintained at about −100 dB.

FIG. 7 is a smith chart showing an H-Plane radiated electric field pattern, i.e., horizontal polarization, by a first antenna of the H-type monopole isolation antenna in accordance with the embodiment of the present invention.

As shown in FIG. 7, a gain is maintained at 1.8 dBi and shows a semi-omni-directional characteristic in an H plane.

Herein, the polarization shown in the drawing is a pattern for an electric field element of an ψ direction.

FIG. 8 is a smith chart showing the H-plane radiated electric field pattern, i.e., the horizontal polarization, by a second antenna of the H-type monopole isolation antenna in accordance with the embodiment of the present invention.

As shown in FIG. 8, when the second antenna is fed in a structure that a monopole is horizontally positioned, a gain is about 2.6 dBi and left and right patterns are formed.

Herein, the patterns are largely generated in a direction toward the first antenna by scattered wave abandoned in the first antenna.

The polarization is the pattern for the electric field element of the direction as FIG. 7.

Also, as shown in the drawing, a section, in which beam directions of FIGS. 7 and 8 are the same, is generated. That is, both beam directions are the same in directions of 100 to 145 degree and 215 to 260 degree and it means that communications with a terminal in the beam section are possible in a co-channel.

That is, it shows that the present invention can be used as a bi-directional repeater system, a Radio Frequency Identification (RFID) reader antenna, a wireless Local Area Network (LAN) low output bi-directional repeater antenna and a Radar Cross Section (RCS) measuring antenna.

Also, the present invention can be used as a uni-directional horizontal polarization repeater antenna which can transmit a signal transmitted from a direction of ψ=180 by the first antenna to directions of ψ=100 to 145, and ψ=215 to 260 by the second antenna.

FIG. 9 is a view showing an H-type monopole isolation antenna being fixed on a wall and used in accordance with an embodiment of the present invention. It also shows a method using the H-type monopole isolation antenna in vertical polarization communications.

As shown in FIG. 9, the H-type monopole isolation antenna of the present invention can be independently set up in a wall of a building, or used by connecting to a communication system in the inside of a building.

When the H-type monopole isolation antenna is used by setting up the antenna device supporter 8 on a wall 22 where a fixed iron is fixed, the isolation suggested above can be maintained.

Also, when the antenna device is rotated up and down as much as 90 degree the communications system for the horizontal polarization can be supported.

FIG. 10 is a view showing the H-type monopole isolation antenna being used as a device integrated with a power outlet in accordance with the embodiment of the present invention.

As shown in FIG. 10, the H-type monopole isolation antenna of the present invention can realize a system to which power is supplied through an outlet in vertical polarization communications, such as a bi-directional repeater system, an RFID reader system, a wireless LAN low output bi-directional repeater system and a monitoring system by equipping all circuits in the inside of the covering housing by equipping an outlet 23 in one end of the antenna device supporter 8.

In this case, it is very convenient that the present invention can be simply and independently set up wherever a power code, i.e., the outlet is.

While the present invention has been described with respect to certain preferred embodiments, it will be apparent to those skilled in the art that various changes and modifications may be made without departing from the scope of the invention as defined in the following claims.

The invention claimed is:

1. A transmitting/receiving isolation antenna maintaining high isolation between a transmitting signal and a receiving signal, comprising:

a covering means which includes an electric conductor; and first and second antennas which are symmetrically positioned in right and left parts of the covering means and perpendicular to the covering means respectively, wherein any one of the first and second antennas is operated as a transmitting antenna and the other of the first and second antennas is operated as a receiving antenna.

2. The transmitting/receiving isolation antenna as recited in claim 1, wherein the first antenna is an H-type monopole antenna.

3. The transmitting/receiving isolation antenna as recited in claim 2, wherein the second antenna is a monopole antenna.

4. The transmitting/receiving isolation antenna as recited in claim 1, wherein the covering means has a form of a housing having a space inside.

5. The transmitting/receiving isolation antenna as recited in claim 1, wherein the first antenna, includes:

a left antenna device which is vertically attached to the covering means;

a right antenna device which is vertically attached to the covering means and positioned closely to the left antenna device;

an isolation supporter which is vertically connected to each of the left antenna device and right antenna device and isolates the left antenna device and the right antenna device in parallel; and a first antenna feeding means which is positioned in a center of the isolation supporter.

6. The transmitting/receiving isolation antenna as recited in claim 5, wherein the left and right antenna devices and isolation supporter are formed in a shape of a conductive pipe having a space inside.

7. The transmitting/receiving isolation antenna as recited in claim 6, wherein the first antenna feeding means in which a part connected to a feeding line is positioned inside the isolation supporter to be connected to the feeding line inside the covering means.

8. The transmitting/receiving isolation antenna as recited in claim 7, wherein the second antenna has a structure in which the connector is used and includes a second antenna feeding means which is connected to the feeding line through the inside of the covering means.

9. The transmitting/receiving isolation antenna as recited in claim 6, wherein the first antenna feeding means uses a connector.

10. The transmitting/receiving isolation antenna as recited in claim 5, wherein the first antenna feeding means is wrapped by a dielectric.

11. The transmitting/receiving isolation antenna as recited in claim 1, further comprising:

a supporting means for supporting the covering means by being connected to a lower central part of the covering means.

12. The transmitting/receiving isolation antenna as recited in claim 11, further comprising:

a base for vertically fixing the supporting means on a surface.

13. The transmitting/receiving isolation antenna as recited in claim 12, wherein the base includes an electric wave absorbing means for absorbing electric wave in an upper part of the base.

14. The transmitting/receiving isolation antenna as recited in claim 11, wherein the supporting means includes a power accessing means in one end.

15. The transmitting/receiving isolation antenna as recited in claim 11, wherein the supporting means is formed in a shape of a pipe having a space inside.

16. The transmitting/receiving isolation antenna as recited in claim 1, wherein a feeding direction of the first antenna is perpendicular to a surface contacting the covering means, and a feeding direction of the second antenna is horizontal to a surface connected to the covering means.

* * * * *